US005230125A

United States Patent [19]

Clement et al.

[11] Patent Number: 5,230,125

[45] Date of Patent: Jul. 27, 1993

[54] COMBING MACHINE AND PROCESS FOR FORMING AN EVEN COMBED SLIVER

[75] Inventors: Heinz Clement, Winterthur; Jurg Bischofberger, Raterschen; Hansulrich Eichenberger; Giancarlo Mondini, both of Winterthur, all of Switzerland

[73] Assignee: Rieter Machine Works, Ltd., Winterthur, Switzerland

[21] Appl. No.: 718,013

[22] Filed: Jun. 20, 1991

Related U.S. Application Data

[63] Continuation-in-part of Ser. No. 455,992, Dec. 22, 1989, abandoned.

[30] Foreign Application Priority Data

Dec. 22, 1988 [CH] Switzerland ..... 04754/88
Jul. 2, 1990 [CH] Switzerland ..... 2194/90

[51] Int. Cl.[5] ..... D01G 19/00; D01G 21/00

[52] U.S. Cl. ..... 19/115 R; 19/236; 19/250; 19/150

[58] Field of Search ..... 19/239, 115 R, 236, 19/238, 150, 151, 250, 251, 65 A, 243

[56] References Cited

U.S. PATENT DOCUMENTS 3,440,688 4/1969 Yamamoto et al. .
4,267,620 5/1981 Allen, Jr. ..... 19/239
4,812,993 3/1989 Konig et al. ..... 19/239
4,864,694 9/1989 Konig et al. ..... 19/239

FOREIGN PATENT DOCUMENTS 139236 5/1983 European Pat. Off. .
2734564 2/1979 Fed. Rep. of Germany .
246823 12/1985 Japan .
941438 7/1982 U.S.S.R. .
941441 7/1982 U.S.S.R. .
1225836 3/1971 United Kingdom .
1331740 9/1973 United Kingdom .
2061338 5/1981 United Kingdom .
2081758 2/1982 United Kingdom .

*Primary Examiner*—Clifford D. Crowder
*Assistant Examiner*—Michael A. Neas
*Attorney, Agent, or Firm*—Francis C. Hand

[57] ABSTRACT

The combing machine is provided with a plurality of combing devices for delivering a plurality of combed slivers as well as a drafting system for receiving and drafting the combed slivers for delivery to a can press. A measuring device is provided to measure the thickness of the sliver delivered to the drafting system and to deliver a signal to a control unit which, in turn, regulates the drafting of the sliver within the drafting system in accordance with the received signal in order to obtain an evened combed sliver.

18 Claims, 6 Drawing Sheets

3
4
5
6
7
7a
22
15
13
12

1
2
3
4
7
7a
8
9
10
11
12
13
14
15
16
17
18
20
21
22
27
28
29
30
31
32
33
M
M1

M
2H
2G
2F
2E
2D
2C
2B
2A
44
50
48
46
42
130
122
120
15C
11
40
17
23

10
56
58
52
48(50)
54
60
S

COMBING MACHINE AND PROCESS FOR FORMING AN EVEN COMBED SLIVER

This application is a continuation-in-part application of Ser. No. 07/455,992, filed Dec. 22, 1989, now abandoned.

This invention relates to a combing machine and to a process for forming an even combed sliver. More particularly, this invention relates to a combing machine having a plurality of combing devices and at least one drafting system.

As is known, various types of combing machines have been provided for the combing of fiber and for the formation of a combed sliver from the combed fiber.

For example, British Patent 1,331,740 describes a sliver forming apparatus which comprises a comber means for producing a combed web, condenser means for condensing the combed web into a sliver and a drafting system. However, in this apparatus, a single drive means is used for driving the comber heads, the collecting rollers and the drafting system employed by the apparatus.

German OS 2734564 also describes an apparatus wherein a plurality of combing devices are operated in conjunction with a drafting system in which the operation of the combing devices and drafting system are directly connected.

Generally, in the known combing machines, a combed fiber fleece from a combing device is collected into a fiber sliver through a sliver funnel by means of a pair of delivery rollers installed after the sliver funnel. In addition, a plurality of slivers formed on individual combing heads are, as a rule, transferred parallel to each other over a delivery table to a drafting system located on the combing machine. The fiber slivers are thus doubled and collected into a single fiber sliver which is drafted and subsequently put into a can over a can press. In order to monitor the combed sliver, it has been known to establish (Rieter Company—Combing Machine E7/5) a measuring position for the determination of the sliver thickness in front of a coiler wheel of the can press. If the sliver count deviates from a nominal sliver count, then the combing machine is automatically stopped. This facilitates a subsequent manual check of the machine setting in order to locate the fault which is responsible for the deviation of the count.

With the known version, the drafting system used in the combing machine has to undertake the task of mixing the single slivers or fibers by doubling. In addition, the joints which result in the combing process are to be evened by the drawing process.

With the known combing machine, it is possible to supervise the constancy of the count of the combed sliver delivered. However, should a deviation of a given count value occur, the combing process must be interrupted and the operator must ascertain and correct the cause of the deviation in order to reset the desired count constancy.

This can also occur when a ribbon of wadding delivered to the comber heads from a comber lap does not show a consistent mixture. In this case, the relationship of comber waste/combed sliver and the count constancy of the combed sliver is no longer ensured.

Accordingly, it is an object of the invention to provide a combing machine which is capable of operating in a continuous manner while producing a nearly perfect quality consistence or count constancy of a combed sliver.

It is another object of the invention to provide a combing machine which can be adjusted from time-to-time on a continuous basis to ensure a substantially uniform sliver.

It is another object of the invention to be able to modify existing combing machines to produce a uniform sliver despite variations in the delivery of combed slivers.

Briefly, the invention provides a combing machine which is comprised of a plurality of combing devices each of which is constructed for the delivery of a combed sliver as well as at least one drafting system for receiving and drafting the combed slivers. In addition, the combing machine is provided with a feedback control unit for controlling the drafting system during operation thereof in dependence on the thickness of the sliver delivered to the drafting system. In this respect, the feedback control unit serves to improve the evenness of the combed sliver.

Still further, the combing machine is provided with a can press downstream of the drafting system for storing the drafted sliver.

Regulated drafting systems are known to be used in conjunction with special drawframes. However, the use of such a regulated drafting system on a combing machine has not been previously known. The advantages which accrue are considerable, so that, under certain circumstances, a drafting system passage or a drawframe hitherto coupled at the outlet side can be eliminated and the direct use is possible of the combed sliver delivered by the combing machine on a flyer or an openend spinning machine. This, in turn, brings about increased economy of operation in the operations prior to spinning.

By levelling out of the sliver count in a regulated drafting system, the comber heads also operate continuously with different mixtures of the comber lap without subsequent regulation. Thus, an interruption is no longer necessary and the unevenness resulting from this are eliminated.

In order to increase the number of combing devices or with an increase of the lap weight, under certain circumstances, the combed sliver delivered from the combing devices should be shared between two following drafting systems with one press assigned to each drafting system.

In order to achieve the advantages mentioned, it is recommended that these drafting systems be provided with regulation (feedback control units) which are independent of each other.

The drafting system may include a preliminary drafting zone having a pair of feed rollers for feeding the combed slivers into the zone. In this embodiment, a measuring device is provided for measuring the thickness of a sliver delivered to the drafting system. This measuring device is also connected to the control unit in order to deliver a signal thereto indicative of the thickness of a measured sliver. The control unit is, in turn, connected to one of the feed rollers to control the rotational speed of the feed roller in dependence upon the received signal.

In conjunction with the regulation of the rotational speed of a feed roller of a preliminary draft following a signal from a sliver thickness measuring device, it is advantageous to arrange a sliver storage between the combing devices and the feed rollers which has a similar delivery speed to that achieved by the combing devices and undertakes a compensation for the differing rotational speeds of the feed rollers.

It is further suggested that, as a result of the regulation of the altered rotational speed of the feed roller, an adjustment should be made to the delivery speed of the combing devices to suit the feeding speed on the drafting system of the combed slivers. For example, a drive for driving the combing devices may be driven in dependence on the rotational speed of the feed rollers.

If, as further recommended, the regulation of the rotational speed is effected on one feed roller of a main draft zone, a sliver storage or a compensation between the feed roller of the preliminary draft zone and the combing devices is not necessary.

In order to intensify the drafting process, or to improve this, it is recommended that at least two drafting systems should be installed in cascade, whereby at least one drafting system is provided with a control system. It is conceivable that, with the first drafting system, only a small draft should be undertaken, whilst the greater portion of the draft should be effected on the subsequent drafting system.

For the adjustment of the working process of the combing machine, it is advantageous when the control pulses from the control unit or from the drafting system are transmitted by a higher ranking master computer which is connected to the other machines in the production process, for example to at least the combing devices.

A process, or a device, is particularly advantageous with which an initial drawframe is assigned for the single fiber slivers formed on the combing devices and a preliminary draft is undertaken.

Where the drafting system includes a main drafting zone having a pair of delivery rollers for feeding the combed slivers into the zone, the control unit may be used to drive one of the delivery rollers in dependence upon the signal received from the measuring device in order to control the rotational speed of the delivery roller.

Still further, the combing machine may be constructed with a motor for simultaneously driving the combing devices and sensing means connected to and between the combing devices and the control unit for sensing the tension in at least one of the slivers delivered from the combing devices in order to emit a control signal to the control unit indicative of the sensed tension. In this case, the control unit is connected to the motor in order to vary the speed of the motor in response to the control signal so as to effect a change in the tension of the combined slivers. For example, a sensing means may include a first sensor for monitoring the tension in a sliver delivered from a first of the combing devices and a second sensor for monitoring the tension in a sliver delivered from a last of the combing devices. In this way, if a predetermined threshold is exceeded for the tension in the sliver delivered from the first combing device, then the speed of rotation of the motor is increased so as to simultaneously increase the operating speed of all the combing devices. Likewise, if the sensor for the last combing device indicates a decrease in sliver tension, the operating speed of the motor can be slightly reduced. This, in turn, leads to an increase in sliver tension of all of the slivers.

These and other objects and advantages of the invention will become more apparent from the following detailed description taken in conjunction with the accompanying drawing wherein:

FIG. 1 schematically illustrates a combing machine constructed in accordance with the invention;

FIG. 2 schematically illustrates a part of the combing machine of FIG. 1 with two pairs of delivery rollers forming an initial drafting zone in accordance with the invention;

Figure 1:
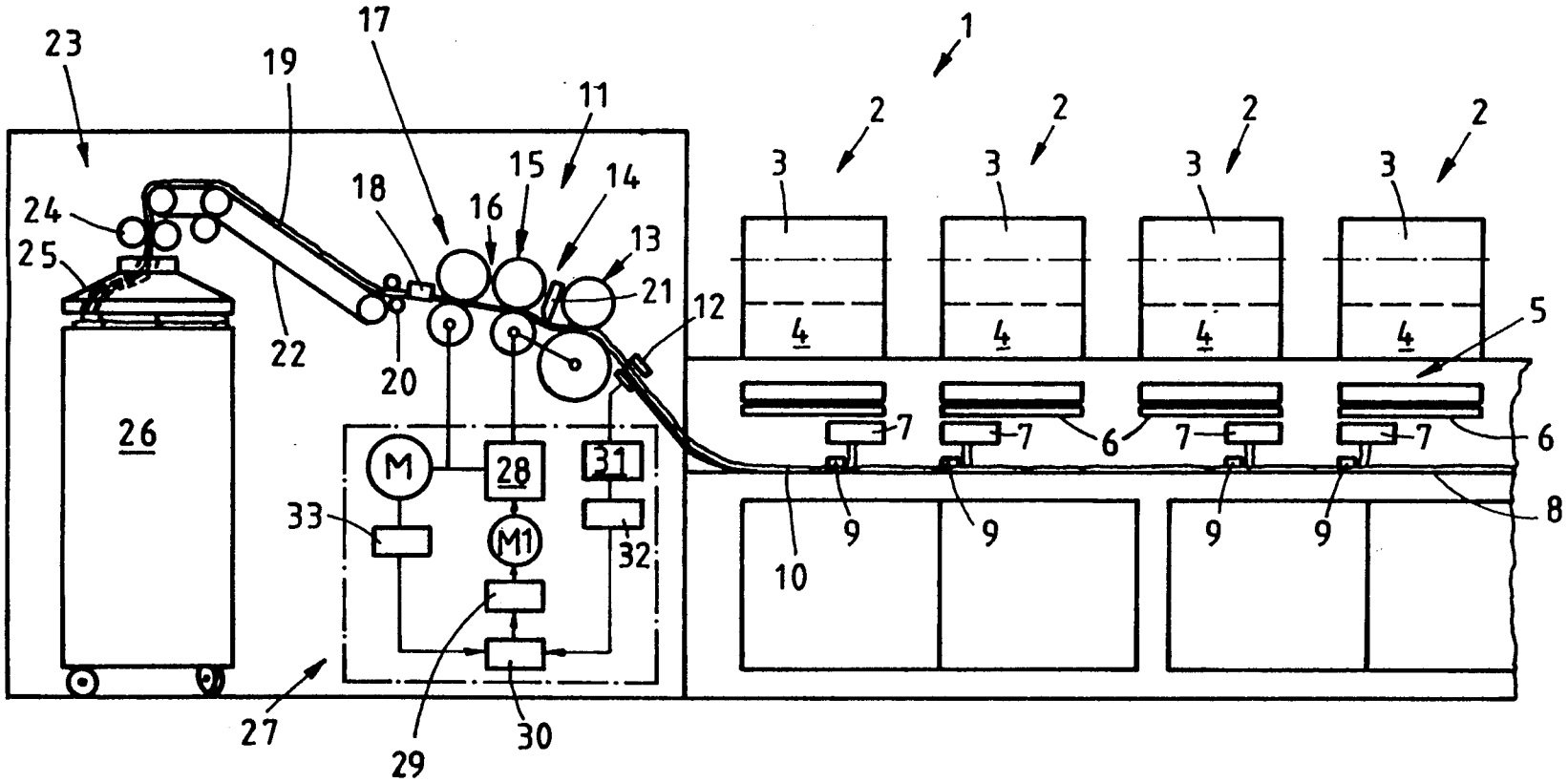
Figure 3:
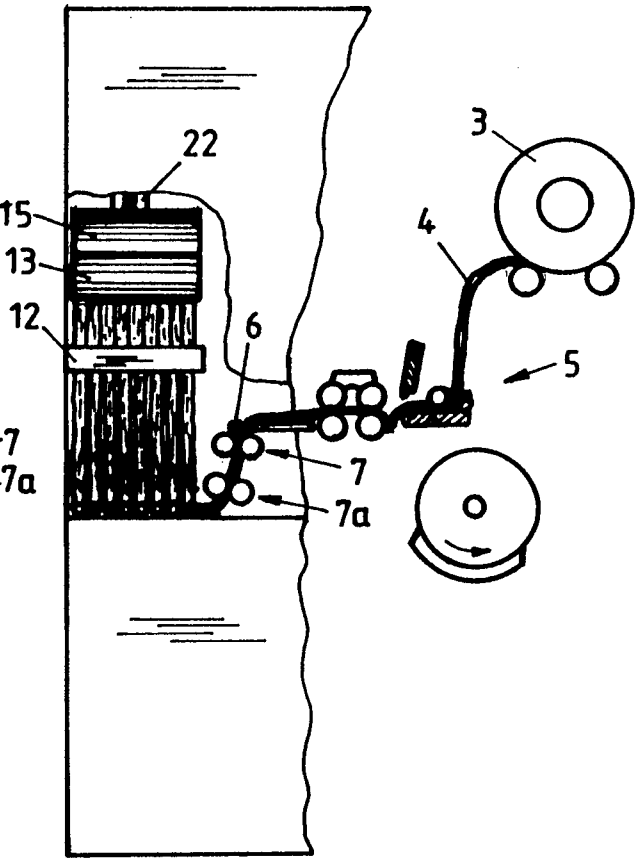
FIG. 3 illustrates a side view of a combing device of FIG. 2.
Figure 2:
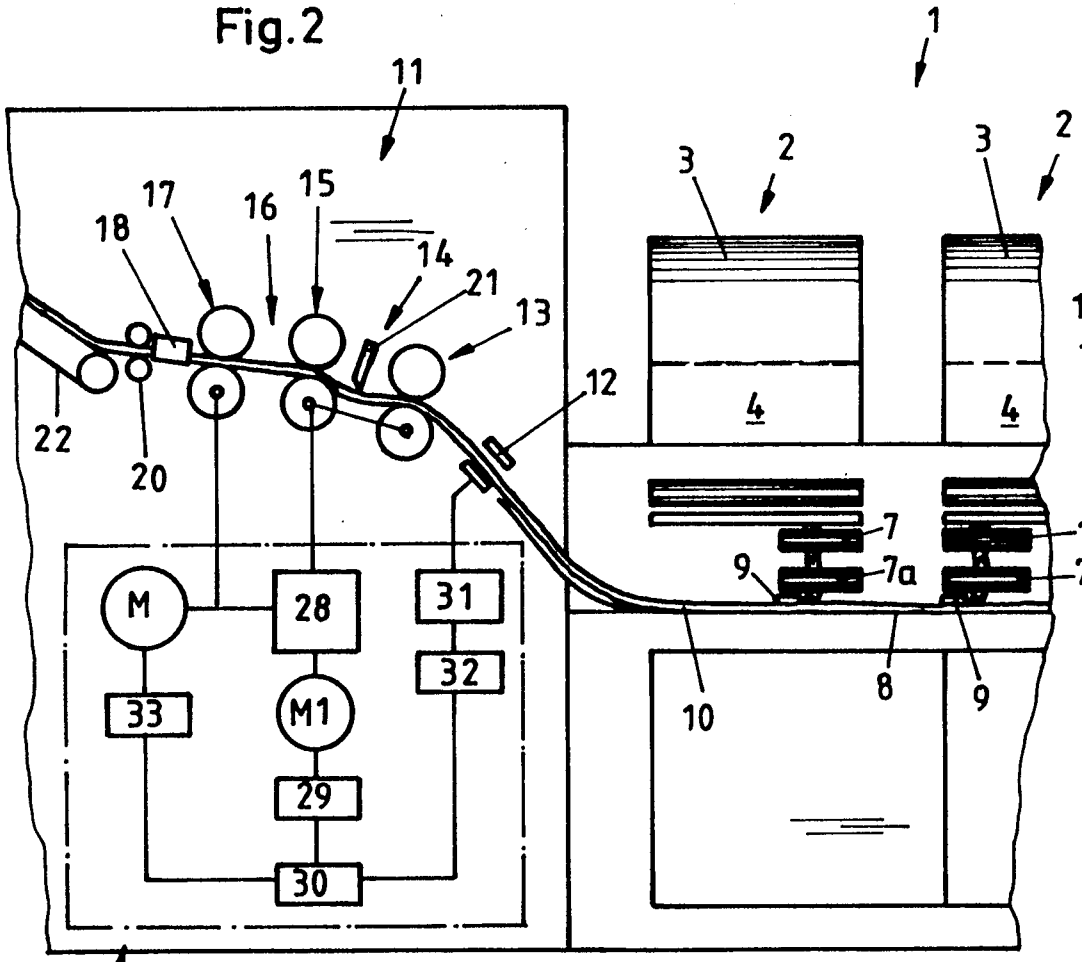

Referring to FIG. 1, the combing machine 1 includes a plurality of combing devices, e.g. eight comber heads 2, of which only four are shown. A lap 3 is shown on every comber head 2 with a wadding 4 fed over a feeder device (not shown) to a comber device 5. Each combing device 5 as indicated in FIGS. 2 and 3, as is generally known, consists of a nipper jaw unit, a comb cylinder located underneath this and, depending on the conveying installation, a top comb arranged behind the nipper jaw unit followed by detaching rollers.

The fiber fleece delivered from the detaching rollers is passed over a take-off table 6 into a delivery funnel (not illustrated in detail) wherein the fiber fleece is collected into a fiber sliver, or combed sliver. This process is supported by the appropriate pair of delivery rollers 7, which deliver the combed sliver to the delivery table 8. In order to convey the fiber slivers 10 parallel to each other on the delivery table 8, sliver guides 9 are provided which are set opposite to each other in the horizontal direction. The fiber slivers 10 are passed in parallel to each other to a drafting system.

As illustrated in FIG. 1, a measuring unit 12 is provided at the input of the drafting system 11, which senses the thickness of the incoming fiber slivers.

This measuring unit 12 can be selected from different designs, e.g., optical or mechanical.

After the passage through the measuring unit 12, the fiber slivers pass between the feed rollers 13 of a preliminary draft zone 14 of the drafting system 11 to a pair of intermediate rollers 15 which are, at the same time, the guide feed rollers for a subsequent main draft zone 16. The drafted slivers 10 pass over delivery rollers 17 at the outlet of the main draft zone 16 to a sliver funnel 18, which is schematically represented and are collected there to a single combed sliver 19 with the aid of take-off rollers 20.

A pressure bar 21 is fitted in the preliminary draft zone 14 for the guidance of the fibers. This pressure bar 21 can also be arranged in the main draft zone 16.

The combed sliver 19 delivered from the take-off rollers 20 is passed to a conveyor 22 and is then delivered to a can press 23 downstream of the drafting system 11.

The combed sliver 19 is laid into a can 26 over calendar rollers 24 and a coiler wheel 25.

The drafting system 11 is provided with a feedback control unit 27 wherein the drive to the lower rollers of the roller pairs 13, 15 and 17 is effected from a main motor M and an epicyclic gear unit 28 is interposed for the drive of the lower roller 15. The drive of the lower roller 13 is taken directly from the lower roller 15. A variable speed motor Ml is assigned to the epicyclic gear unit 28, which is controlled over a control unit 29. The control unit 29 receives pulses from a set point station 30, in which the measuring voltage initiated through the measuring device 12 over a signal converter 31 and a timing component 32 is compared with the control voltage delivered from a master tachometer 33 of the main motor M and from this a nominal voltage for the control unit results.

A sliver monitor can be provided additionally before the entry into the calendar rollers 24 for the supervision of the levelled combed sliver.

If a difference from the nominal sliver thickness value is determined by the measuring device 12 then, in this case, a time delay is applied over the control unit 27 of the variable speed motor Ml, which meshes with the epicyclic gear unit 28 and an alteration in the speed of rotation of the intermediate roller 15 is effected, which also affects the feed roller 13, whilst the delivery roller 17 maintains an unaltered speed of rotation. This means., as a result of the altered rotational speed difference between the intermediate roller 15 and the delivery roller 17, the draft is suited to the sliver thickness determined by the measuring device 12.

As already explained in the introductory description, drawframes of a different construction with different control units to that used here can be used. (For example, a Schubert and Salzer Company drawframe, Model - RSB 51).

Referring to FIGS. 2 and 3, wherein like reference characters indicate like parts as above, it is also conceivable that a further pair of rollers can be arranged subsequent to the take-off rollers 7, which are driven at a somewhat higher rotational speed in order to reduce the stress on the fiber sliver during the preliminary draft before the sliver is passed to the delivery table 8 and doubled with the others. Thus, the rollers 7, 7*a* define a preliminary drafting zone.

Figure 4:
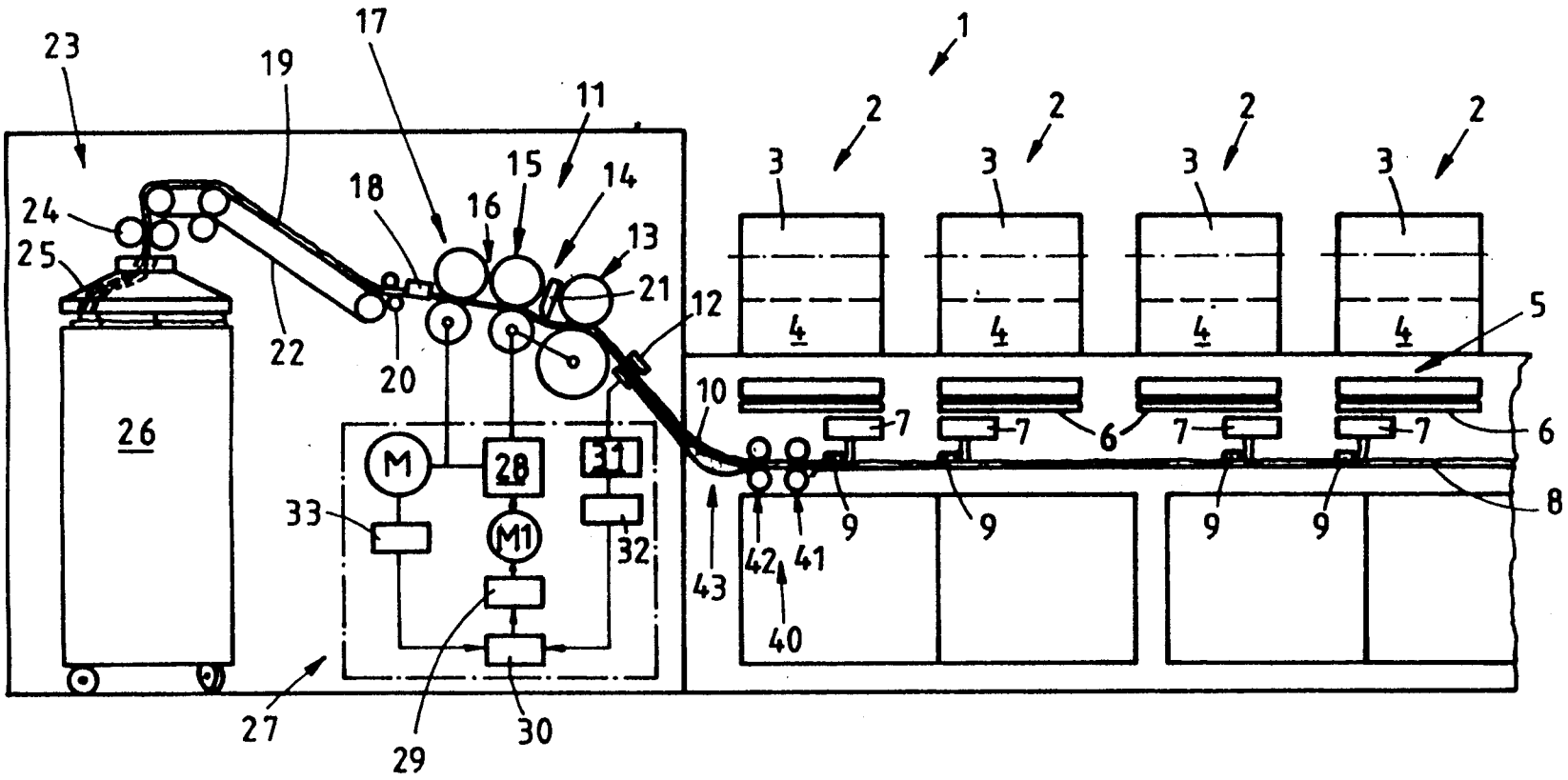
FIG. 4 illustrates a view similar to FIG. 1 of a modified combing machine employing a pair of drafting systems and a sliver storage in accordance with the invention.

Referring to FIG. 4, wherein like reference characters indicate like parts as above, a preliminary drafting zone 40 may be provided by pairs of rollers 41, 42 in the path of the slivers while a sliver storage 43 is disposed between the preliminary drafting zone 40 and the feed rollers 13 of the drafting system 11.

Figure 5:
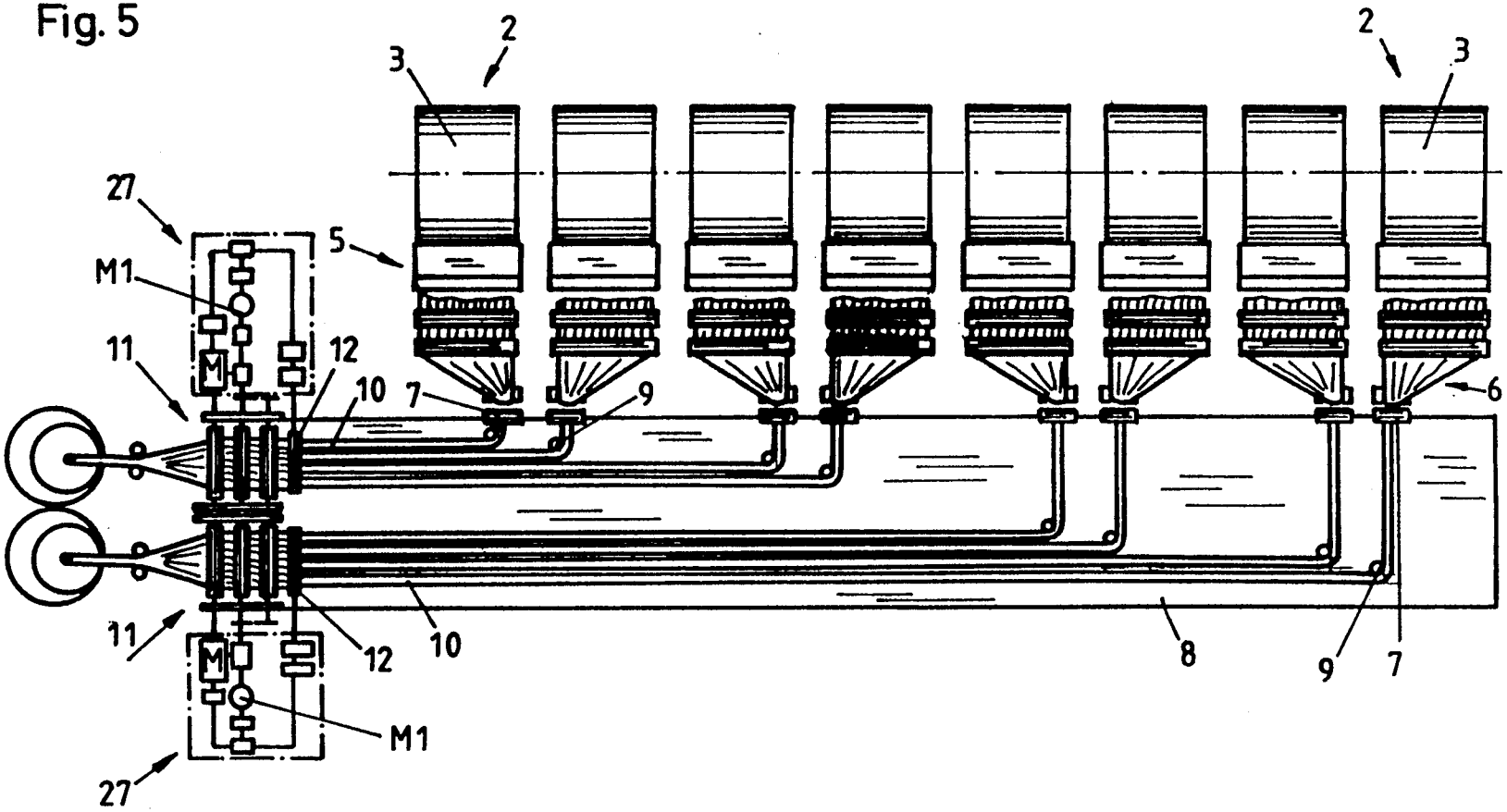
FIG. 5 illustrates a view of a combing machine having two drafting systems disposed in parallel in accordance with the invention.

Referring to FIG. 5, wherein like reference characters indicate like parts as above, the combing machine may be constructed with two drafting systems 11 disposed in parallel with each system 11 disposed to separately and independently receive combed slivers 10 from the combing devices 2.

Figure 6:
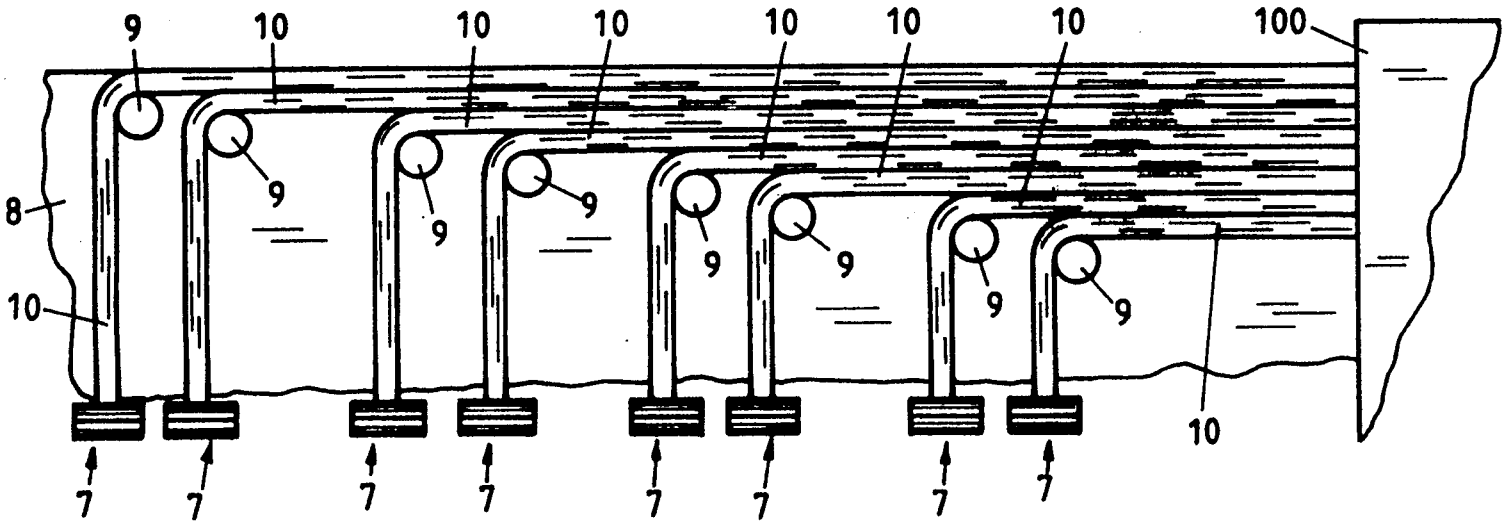
FIG. 6 illustrates a plan view of the feed table of the machine of FIG. 1.
Figure 7:
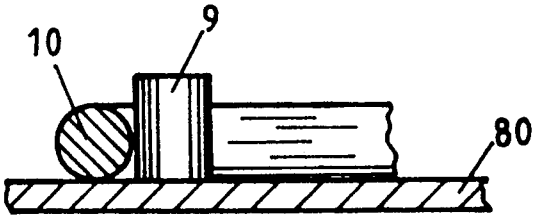
FIG. 7 illustrates a detail view of a sliver guide on the feed table of FIG. 1.

Referring to FIG. 6, by way of example, the combing machine 1 may have pairs of delivery rollers 7 for each of eight combing heads 2 with each pair of delivery rollers 7 delivering a sliver 10 onto the delivery table 8. In this embodiment, the feed table 8 is in the form of a plate which consists of a horizontally disposed metal sheet 80 (see FIG. 7) which is supported by the machine frame (not shown). After leaving the respective pair of delivery rollers 7, each sliver 10 lies on the sheet 80 while being diverted through approximately 90° around a respective sliver guide 9 and while being fed to a unit 100 which contains the drafting system 11 as in FIG. 1. This general structure is well known in the art and is shown, for example, in FIG. 3 of the article "The Combing Room as Decisive Economic Factor in the Short Staple Spinning Mill", Melliand Textilberichte, Volume 9/1990, pages 330 to 332 as well as in European Patent Application 0339300. The sliver guide 9 is, however, preferably formed in accordance with European Patent Application 0349866.

The evener drafting system 11 (see FIG. 1) is preferably arranged to even out sliver count variations with a very short wave length. This drafting arrangement should, in particular even out sliver count variations caused by the so-called piecing operation in the conventional combing process. Details of the conventional combing process may be found, for example, in the book "Drawing, Combing and Roving" of Zoltan Szaloeki, published by the Institute of Textile Technology or the handbook "A practical guide to combing and roving" by Werner Klein, published by The Textile Institute.

In accordance with the previously described embodiment of the evener drafting system 11, sliver count variations are evened out by varying the infeed speed. In order to even out the effects of piecing, these changes in the infeed speed must exhibit quite a high frequency. High frequency changes in the infeed speed are associated with corresponding high frequency changes in the tensile force (i.e. the tension) in the sliver 10 on the feed table 8. However, provided the average value of the tensile force (tension) in each sliver remains within a predetermined tolerance range around a predetermined set value, these small speed changes will not lead to any changes in the slivers 10 on the table 8 which cannot be evened out.

Figure 8:
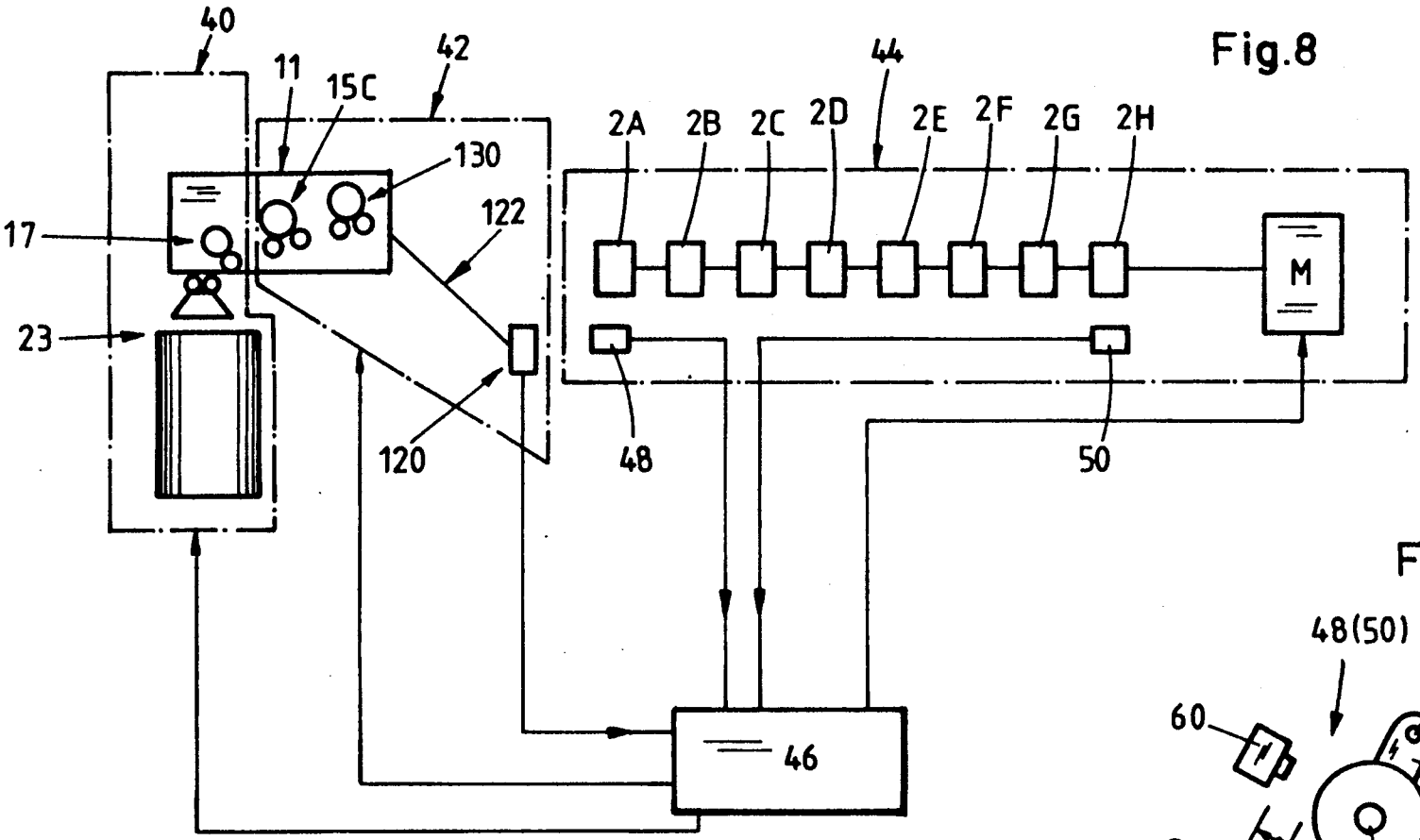
FIG. 8 illustrates a modified side view of a modified combing machine employing sensing elements in accordance with the invention.

The preferred arrangement enables a drive concept for the machine as illustrated diagrammatically in FIG. 8. To this end, the drive system of the machine is divided into three drive groups 40', 42', 44'. One drive group 40' comprises both the delivery roller pair 17 of the evener drafting system 11 and the coiler 23. These elements are driven with a constant speed which can, however, be set selectively in dependence upon the desired production rate of the machine. The setting can be effected via a microprocessor control unit 46 for the complete machine. It is unimportant in this context whether the roller pair 17 and the coiler 23 are each provided with an individual drive motor or whether both elements are driven from a common drive motor by respective gear trains.

The second drive group 42' comprises the middle roller group 150 and the infeed roller group 130 of the evener drafting system 11. The speed of this drive group is variable so that mass variations of the infeed slivers, sensed at a measuring point 120, are evened out via the microprocessor 46 by changing the infeed speed of the drafting system 11 as described above with respect to the embodiment of FIG. 1. An upwardly inclined metal plate 122 guides the slivers from the measuring position to the drafting system 11. As also described in connection with FIGS. 6 and 7, the small changes in rpm at the infeed to the drafting system 11 lead to small changes in tension on the table 8. However, because a considerable length of sliver 20 is provided between the infeed to the drafting system 11 and the respective roller pair 7 (see FIGS. 1 and 6), this length of sliver acts as a "store". This "store"0 is, in turn, able to absorb small variations in tension arising from the drafting system 11 without causing drafting defects on the table 8 which cannot be evened out. This applies both for the combing head 2A (see FIG. 8) closest to the drafting system 11 and to the combing head 2H (see FIG. 8) spaced furthest from the drafting system 11. A requirement for this advantageous storage effect on the table 8 is a sliver tension on the table lying between certain upper and lower limit values.

The third drive group 44' comprises the main motor M which drives all the combing heads 2A, 2B, 2C, 2D, 2E, 2F, 2G, 2H at a predetermined operating speed during normal operation. This operating speed is also selectively settable via the microprocessor 46 in dependence upon the desired production rate for the whole machine. The sliver tension on the table is dependent upon the relation between the speed at the delivery from the drafting system 11 and the speed of the main motor M. In order to ensure a predetermined sliver tension on the table 8, it is therefore possible to adapt the operating speed of the main motor (i.e. of the combing heads 2A to 2H) at a constant delivery speed of the drafting system 11 (i.e. with a constant production rate for the whole machine) in order to avoid undesired tension conditions on the table 8. Such undesired conditions can arise from changes in the condition of the table itself over time, e.g. between periodic cleaning operations.

In principle, it would be possible to monitor the tension in each delivered sliver 10 and to adapt the operating speed of the motor M accordingly. However, this is not essential because an undesirably high sliver tension will first become manifest in the sliver 10 of the combing head 2A and a too-low sliver tension will appear first in the sliver 10 of the combing head 2H. It is therefore possible to monitor for conformity within predetermined upper and lower limit values for the tension of all slivers on the table 8 by monitoring the sliver tension in the outer slivers.

Advantageously, a sensing means is provided which has a first sliver tension sensor 48 associated with the combing head 2A and a second sliver tension sensor 50 associated with the combing head 2H. If a predetermined threshold is exceeded for the tension in the sliver 10 (see FIG. 1) delivered by the combing head 2A, then the speed of rotation of the main motor M is increased slightly in order to increase simultaneously the operating speed of all the combing heads 2A to 2H. The increased operating speed of the combing heads 2A to 2H, with an unchanged delivery speed of the drafting system 11 (i.e. with unchanged production of the machine) leads to a reduction in tension on the table 8. This counteracts, e.g. an increase in friction between the slivers and the metal sheet 80 (see FIG. 7). Such an increase in tension conditions could arise, for example from deposition of fly over time.

If the signal from the second sliver tension sensor 50 indicates that the tension in the sliver delivered by the combing head 2H has fallen below a predetermined threshold level, the operating speed of the main motor M can be slightly reduced. With an unchanged production rate for the machine, this lead to an increase in sliver tension on the table 8. A low sliver tension could arise, for example, because the operating speed has been increased before cleaning of the table 8 in order to compensate for unfavorable friction conditions on the table 8 and the operating speed setting is then too high after such cleaning has been performed.

Figure 9:
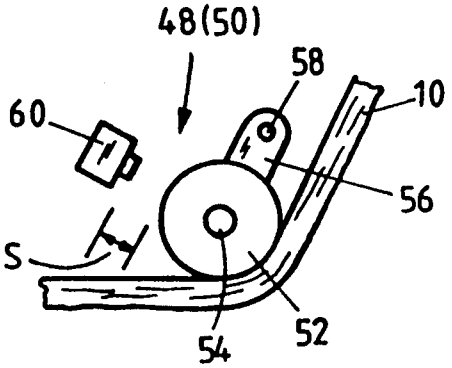
FIG. 9 illustrates a detail of a sensing arrangement according to FIG. 8.

Referring to FIG. 9, a suitable arrangement for use as the sensor 48, 50 for maintaining the tension in a sliver 10 may include a roller 52 which is rotatably mounted on a shaft 54 which, in turn, is carried by a lever 56 which is pivotally mounted about a pivot pin 58. This lever 56 is biased, for example, by a spring (not shown) in a counter-clockwise direction, as viewed, about the pin 58 in order to press the roller 52 against the sliver 10. The sliver 10 is therefore guided around the roller 52 with an approximately predetermined angle of wrap.

The angular position of the lever 56 about the pivot pin 58 is therefore dependent upon the tension in the sliver 10. An increase in sliver tension leads to rotation of the lever 56 in a clockwise direction about the pin 58 and a reduction in the sliver tension leads to a rotation of the lever 56 in a counter-clockwise direction around the pin 58 under the influence of the non-illustrated spring. These rotational movements of the lever 56 can be detected by a proximity sensor 60.

In the case of the first sensor 48 (see FIG. 8) the proximity sensor 60 is set so that at a certain minimum spacing S between the sensor 60 and the roller 52, a signal is sent to the microprocessor 46 (see FIG. 8) to cause an increase in the operating speed of the motor M. In the case of the second sensor 50, the sensor 60 is set so that at a predetermined maximum spacing S between the sensor 60 and the corresponding roller 52, a signal is sent to the microprocessor 46 to cause a reduction in the operating speed of the main motor M.

The sensor 60 is preferably a non-contact sensor which may be of the electromagnetic type. A sensor arrangement in accordance with FIG. 9 can be provided on the table 8, for example between the delivery roller pair 7 and the sliver guide 9 shown in FIG. 6 for the respective sliver. However, the roller 52 of an arrangement according to FIG. 9 may also be constructed as a sliver guide 9 in a structure according to FIG. 6.

The invention thus provides a combing machine wherein deviations in a given count value of a delivered sliver can be corrected without having to interrupt the combing process. Further, the invention provides a combing machine which is of relatively simple construction.

The invention further provides a combing machine which is able to produce an even combed sliver in a relatively simple manner on an economical basis.

What is claimed is:

1. A combing machine comprising a plurality of combing devices for delivering a plurality of combed slivers;

at least one drafting system for receiving and drafting the combed slivers, said drafting system including a preliminary drafting zone having a pair of feed rollers for feeding the combed slivers into said zone;

a store of slivers between said feed rollers and said combing devices;

means for adjusting the tension in the slivers in said sliver store;

a can press downstream of said drafting system for storing the drafted sliver;

a feedback control unit for controlling said drafting system during operation thereof in dependence on the thickness of the sliver delivered to said drafting system; and a measuring device for measuring the thickness of a sliver delivered to said drafting system, said measuring device being connected to said control unit to deliver a signal thereto indicative of the thickness of a measured sliver, said control unit being connected to one of said feed rollers to control the rotational speed of said one feed roller in dependence on said signal.

2. A combing machine as set forth in claim 1 which comprises at least two of said drafting systems disposed in parallel, each said drafting system being disposed to separately and independently receive combed slivers from said combing devices.

3. A combing machine as set forth in claim 1 which further comprises a drive for driving said combing devices in dependence on the rotational speed of said feed rollers.

4. A combing machine as set forth in claim 1 wherein said drafting system includes a main drafting zone having a pair of delivery rollers for feeding the combed slivers into said zone and said control unit is connected to one of said delivery rollers to control the rotational speed of said one delivery roller in dependence on said signal.

5. A combing machine as set forth in claim 1 which comprises at least two of said drafting systems disposed in sequential order, said control unit being connected to at least one of said drafting systems.

6. A combing machine as set forth in claim 1 which further comprises a master computer connected to at least one of said combing devices and to said control unit to receive control pulses therefrom.

7. A combing machine as set forth in claim 6 which comprises at least two of said drafting systems disposed in parallel, each said drafting system being disposed to separately and independently receive combed slivers from said combing devices.

8. A combing machine comprising a plurality of combing devices for delivering a plurality of combed slivers;

a motor for simultaneously driving said combing devices;

at least one drafting system for receiving and drafting the combed sliver while maintaining a tension in each sliver;

a first sensor for monitoring the tension in a sliver delivered from a first of said combing devices;

a second sensor for monitoring the tension in a sliver delivered from a last of said combing devices; and a control unit connected to and between said sensors and said motor for increasing the speed of said motor in response to a signal from said first sensor indicative of an increase in tension in the sliver monitored thereat and for decreasing the speed of said motor in response to a signal from said second sensor indicative of a decrease in tension in the sliver monitored thereat.

9. A combing machine as set forth in claim 8 wherein at least one sensor includes a pivotally mounted lever, a roller rotatably mounted on said lever for guidance of a sliver thereover and a proximity sensor spaced from said roller for emitting a signal in response to movement of said roller beyond a predetermined spacing from said proximity sensor.

10. A combing machine as set forth in claim 8 which further comprises a measuring device for measuring the thickness of a sliver delivered to said drafting system, said measuring device being connected to said control unit to deliver a control signal thereto indicative of the measured thickness of a sliver, and said control unit being connected to said drafting system to vary the drafting of the combed slivers in dependence on said control signal.

11. A combing machine comprising a plurality of combing devices for delivering a plurality of combed slivers;

a motor for simultaneously driving said combing devices;

a drafting system for receiving and drafting the combed slivers;

a measuring device between said combing devices and said drafting system for measuring the thickness of a sliver delivered to said drafting system and emitting a signal indicative of the measured thickness;

a control unit connected to and between said measuring device and said drafting system for controlling said drafting system during operation thereof in dependence on said signal;

sensing means connected to and between said combing devices and said control unit for sensing the tension in at least one of the slivers delivered from said combing devices and emitting a control signal to said control unit indicative of the sensed tension, said control unit being connected to said motor to vary the speed of said motor in response to said control signal to effect a change in the tension of the combed slivers; and a can press for receiving and storing the drafted sliver directly from said drafting system.

12. A combing machine as set forth in claim 11 wherein said sensing means includes a first sensor for monitoring the tension in a sliver delivered from a first of said combing devices and a second sensor for monitoring the tension in a sliver delivered from a last of said combing devices.

13. A process of forming an even combed sliver comprising forming a plurality of combed slivers into a sliver store with the slivers held in tension;

collecting the combed slivers into a single sliver;

delivering the single sliver into a drafting system;

measuring the thickness of the single sliver delivered to the drafting system;

drafting the sliver in the drafting system in dependence on the measured thickness of the single sliver to obtain an even sliver; and adjusting the tension in the sliver in the sliver store to a predetermined tension in dependence on a constant delivery speed of the drafting system.

14. A process as set forth in claim 13 which further comprises the step of delivering the even sliver into a can press.

15. A combing machine comprising a plurality of combing devices for delivering a plurality of combed slivers;

at least one drafting system for receiving and drafting the combed slivers, said drafting system including a preliminary drafting zone having a pair of feed rollers for feeding the combed slivers into said zone;

a can press downstream of said drafting system for storing the drafted sliver;

a feedback control unit for controlling said drafting system during operation thereof in dependence on the thickness of the sliver delivered to said drafting system;

a measuring device for measuring the thickness of a sliver delivered to said drafting system, said measuring device being connected to said control unit to deliver a signal thereto indicative of the thickness of a measured sliver, said control unit being connected to one of said feed rollers to control the rotational speed of said one feed roller in dependence on said signal; and a drive for driving said combing devices in dependance on the rotational speed of said feed rollers of said drafting system.

16. A combing machine as set forth in claim 15 wherein said drive includes a motor for driving said combing devices and a master computer connected to said control unit to receive control pulses therefrom and to said motor to change the speed of said motor in response to said pulses.

17. A combing machine comprising a plurality of combing devices for delivering a plurality of combed slivers;

a plurality of drafting devices, each drafting device being disposed downstream of a respective combing device for drafting a combed sliver;

a delivery table downstream of said drafting devices for conveying the slivers thereon in parallel;

a drafting system downstream of said table for drafting of the slivers therein;

a measuring device for measuring the thickness of a sliver delivered to said drafting system;

means downstream of said drafting system for forming the drafted slivers into a single sliver;

a can press downstream of said means and said drafting system for storing the drafted sliver; and a feedback control unit for controlling said drafting system during operation thereof in dependence on the measured thickness of the sliver delivered to said drafting system.

18. A combing machine comprising a plurality of combing devices for delivering a plurality of combed slivers;

a plurality of drafting devices, each drafting device being disposed downstream of a respective combing device for drafted a combed sliver;

a delivery table downstream of said drafting devices for conveying the slivers thereon in parallel;

a drafting system downstream of said table for drafting of the slivers therein;

a sliver storage between said drafting system and said combing devices;

a measuring device for measuring the thickness of a sliver delivered to said drafting system;

a feedback control unit for controlling said drafting system during operation thereof in dependence on the thickness of the sliver delivered to said drafting system;

means downstream of said drafting system for combining the drafting slivers into a single sliver; and a can press downstream of said means and said drafting system for storing the drafted sliver.

* * * * *